US005134025A

United States Patent [19]

Zenda et al.

[11] Patent Number: 5,134,025

[45] Date of Patent: Jul. 28, 1992

[54] ULTRAVIOLET RAY-REFLECTING FABRIC

[75] Inventors: Tatuya Zenda; Yasunao Simano; Masaaki Nakamura; Ryosei Takigaura, all of Ishikawa, Japan

[73] Assignee: Komatsu Seiren Co., Ltd., Ishikawa, Japan

[21] Appl. No.: 349,412

[22] Filed: May 8, 1989

[30] Foreign Application Priority Data

Aug. 29, 1988 [JP] Japan ..... 63-212399

[51] Int. Cl.[5] ..... B32B 5/16

[52] U.S. Cl. ..... 428/317.9; 428/327; 428/919; 428/262

[58] Field of Search ..... 428/262, 290, 312.2, 428/317.9, 327, 331, 919

[56] References Cited

U.S. PATENT DOCUMENTS 3,951,899 4/1976 Seiner ..... 260/29.6
4,347,284 8/1982 Tsutomu et al. ..... 428/328
4,554,198 11/1985 von Blücher et al. ..... 428/143

FOREIGN PATENT DOCUMENTS 62-169814 7/1987 Japan .
63-24141 7/1988 Japan .

*Primary Examiner*—George F. Lesmes
*Assistant Examiner*—Terrel Morris
*Attorney, Agent, or Firm*—Burns, Doane, Swecker & Mathis

[57] ABSTRACT

An ultraviolet ray-reflecting fabric comprising a fibrous fabric substrate and a polymer film formed thereon having a foamed cell structure and containing fine particles. This fabric has a very high ultraviolet ray-reflecting performance and an excellent moisture permeability and water proofing, and is further characterized in that the fabric is soft, has a light weight and does not become too hot even when exposed directly to the rays of the sun.

2 Claims, No Drawings

ULTRAVIOLET RAY-REFLECTING FABRIC

BACKGROUND OF THE INVENTION (1) Field of the Invention

The present invention relates to an ultra-violet ray-reflecting fabric. More particularly, the present invention relates to a white moisture-permeable water-proof fabric having a very high ultraviolet ray-reflection efficiency and used for camouflaging goods or persons against detection during reconnaissance by the naked eye of ice fields or snow fields, by ultraviolet filter photography, and by various ultra-violet detectors used for military purposes.

Furthermore, this fabric can be used in the leisure field as a suntan-promoting mat having a high ultraviolet-reflection efficiency, and can be used, for example, on the beach for rapidly obtaining a better suntan.

(2) Description of the Related Art

Recently, military reconnaissance is carried out not only by the naked eye but also by using ultra-violet filter photography or various ultraviolet detectors. Accordingly, the development of an article-camouflaging or a personnel camouflaging sheet or clothing having an ultraviolet ray-reflection efficiency in the ultraviolet wavelength region equal or close to that of snow, is urgently required as a protection against such a reconnaissance using ultraviolet rays.

As the means for meeting this requirement, recently processing methods of imparting an ultraviolet ray-reflecting capacity to a fabric have been proposed. For example, Japanese Unexamined Patent Publication No. 62-169814 discloses an ultraviolet ray-reflecting material containing fine resin particles obtained by polymerizing a condensable triazine compound, and teaches that a white sheet obtained by incorporating the above-mentioned resin particles into a vinyl chloride resin or an acrylic rubber has an ultraviolet ray reflectance of 97 to 98% at a wavelength of 350 nm. Furthermore, Japanese Examined Utility Model Publication No. 63-24141 teaches that a synthetic fiber woven fabric having innumerable voids in the interior of the fiber has a reflectance of 69% at a wavelength of 360 nm. The former sheet has a composite structure comprising a substrate layer and an outer layer and the latter sheet has a single layer structure composed solely of the fiber. The sheet having a composite structure is characterized by an excellent water proofing and a very high ultraviolet reflectance, but is disadvantageous in that the softness is poor, the sheet has no air permeability or no moisture permeability, and the weight thereof is heavy. The single-layer sheet composed solely of the fiber has a light weight and a good softness, and is air-permeable and moisture-permeable, and thus this sheet is comfortable when worn in the form of clothing. Nevertheless, this sheet is disadvantageous in that the ultraviolet ray reflectance is not as high as that of the sheet having a composite structure and the waterproofing is poor. Accordingly, each of the above sheets has advantages and disadvantage, and thus the required performances have not been obtained therefrom.

In the leisure field, a sheet comprising a fibrous fabric substrate coated with an aluminum film is marketed as a suntan-promoting mat, and if this mat is used on the beach or the like, not only rays from the sun but also rays reflected from the mat spread below the body are effectively utilized for the suntanning, and therefore, a good suntan is rapidly obtained. This mat has an ultraviolet reflection efficiency of about 60% at a wavelength of 300 to 400 nm, but is disadvantageous in that the sheet per se becomes very hot when exposed directly to the rays of the sun, and thus even ultraviolet rays having a wavelength shorter than 320 nm, which are harmful to the skin, are reflected. Accordingly, an excessive heating must be prevented, even when exposed directly to the rays of the sun, whereby the reflection of ultraviolet rays having a wavelength of at least 320 nm is further increased while blocking harmful ultraviolet rays having a wavelength shorter than 320 nm, and thus a suntan-promoting mat which is more effective than the commercially available aluminum-coated mat, will be obtained.

SUMMARY OF THE INVENTION

A primary object of the present invention is to provide an ultraviolet ray-reflecting fabric to be used for military purposes, with which, by using a composite structure comprising a fibrous fabric substrate layer and a resin layer, an excellent UV ray-reflection and a very high water proofing can be obtained, and the problems of moisture permeability, softness and weight reduction of the conventional sheet having a composite structure, can be solved.

Another object of the present invention is to provide a suntan-promoting mat which does not become too hot when exposed directly to the rays of the sun, cuts harmful ultraviolet rays having a wavelength shorter than 320 nm, has a very high reflection efficiency of ultraviolet rays having a wavelength of at least 320 nm, and is more effective than the commercially available aluminum-coated sheet.

In accordance with the present invention, the above objects can be realized by providing an ultraviolet ray-reflecting fabric having a fibrous fabric substrate and having formed thereon a polymer film having a foamed cell structure and containing fine particles.

DESCRIPTION OF THE PREFERRED EMBODIMENTS

The present invention will now be described in detail.

The polymer film having a foamed cell structure, according to the present invention, is the same as that usually formed on a fibrous fabric substrate in the production of an artificial leather. For example, there can be mentioned a film having a foamed cell structure obtained by coating a solution of a polyurethane in dimethylformamide on the substrate and coagulating the coating with water, and a porous film obtained by stirring a dispersion of a urethane in a solvent such as toluene and water by a homo-mixer to obtain a polyurethane emulsion, coating the emulsion on a substrate, and drying the coating, as disclosed in Japanese Examined Patent Publication No. 59-33611.

The obtained polymer film having a foamed cell structure has a very high ultraviolet ray reflectance, and by dispersing and incorporating fine particles in the polymer film, an even higher ultraviolet ray reflectance can be obtained.

The fine particles to be added in the present invention are inorganic or organic particles not showing an absorption of light in the intended ultraviolet ray wavelength region, and particles having an average particle size of 0.1 to 10 μm have a particularly excellent ultraviolet ray-reflection performance. As the inorganic particles, there can be mentioned silica particles; no substantial absorption by silica particles is observed at a wavelength of 300 to 400 nm. As the organic particles, there can be mentioned melamine resin particles; absorption by melamine resin particles is observed at a wavelength of 300 to 330 nm but rays having a wavelength longer than 330 nm are not absorbed. The addition of melamine resin particles is effective when producing the suntan-promoting mat, because ultra-violet rays having a wavelength shorter than 320 nm, which are harmful to the skin, can be cut thereby.

The ratio of addition of the fine particles has an influence on the ultraviolet ray-reflecting performance, and preferably the fine particles are added in an amount of about 10 to about 150 parts by weight per 100 parts by weight of the solids of the urethane resin. If too small an amount of the fine particles is added, the reflectance is reduced, and if too large an amount of the fine particles is added, the urethane film becomes brittle.

Furthermore, the thickness of the urethane resin layer had an influence on the ultraviolet ray-reflecting performance, and therefore, a larger thickness of the urethane film is preferable, and a thickness of 5 to several hundred μm is recommended for military purposes.

The ultraviolet ray-reflecting performance required for an ultraviolet ray-reflecting fabric to be used for military purposes is considered to be a reflectance of at least 65% at a wavelength of 350 nm, and in this connection, where silica particles are added to the polymer film having a foamed cell structure, it is possible to increase the ultraviolet ray reflectance to about 90%, and if melamine resin particles are added, it is possible to increase the ultraviolet ray reflectance to more than 95%.

Where silica particles or melamine resin particles are incorporated into a non-foamed film, the reflectance is much lower than the above-mentioned reflectance, and thus it is obvious that the required reflectance cannot be obtained by the ultraviolet ray-reflecting performance of silica particles or melamine resin particles alone. Namely, in the present invention, a very high ultraviolet reflectance can be obtained only by using the two constituent elements, i.e., the foamed cell structure and the fine particles, and if either of these elements is omitted, good results cannot be obtained.

Since the fabric of the present invention is covered with the polymer film having a foamed cell structure, the fabric is characterized in that the fabric is not only waterproof but also has a moisture permeability. Namely, the water pressure resistance is at least 500 mm and the moisture permeability is at least 2000 g/m$^2$.24 hours.

Furthermore, since the polymer film of the fabric of the present invention has a foamed structure and contains an air layer, the film per se is soft, the weight of the film is reduced, and the fabric of the present invention is characterized in that it does not become too hot even when exposed directly to the rays of the sun. Namely, the above-mentioned fabric of the present invention has a very high ultraviolet ray-reflecting performance and an excellent moisture permeability and waterproofing, and the fabric of the present invention is further characterized in that the fabric is soft, the weight is light, and the fabric does not become too hot. Accordingly, for military purposes, the fabric of the present invention can be satisfactorily used as a cover or clothing for camouflaging goods or personnel against detection during a reconnaissance by the naked eye in ice fields or snow fields, by ultraviolet filter photography, or by various ultra-violet detectors. Furthermore, in the leisure field, the fabric of the present invention is effective as a suntan mat which will not harm the skin and has a high suntan-promoting effect.

The present invention will now be described in detail with reference to the following examples that by no means limit the scope of the invention. Note, in the examples, all of "parts" are by weight.

EXAMPLE 1

A coating liquid formed by mixing and stirring 100 parts by weight of a wet urethane type of the non-yellowing type (CR 3930 C supplied by Fai-Nippon Ink) with 15 parts of melamine resin particles having an average particle size of 0.3 μm (EPS-S supplied by Nippon Shokubai) and 60 parts of dimethylformamide was coated in a thickness of 0.3 mm on a nylon/cotton mix-spun twilled fabric and coagulated with water to obtain a white sheet having a foamed cell structure.

The ultraviolet ray reflectance of this sheet measured by Hitachi Color Analyzer Model 607 was 98% at a wavelength of 330 to 400 nm, the water pressure resistance was 1000 mm, and the moisture permeability was 8000 g/m$^2$.24 hours.

EXAMPLE 2

A sheet was prepared in the same manner as described in Example 1 except that 10 parts of silica particles having an average particle size of 2.5 μm (Syloid 72 supplied by Fuji-Davison) was used instead of the 15 parts of melamine resin particles used in Example 1. The ultraviolet ray reflectance was 90% at a wavelength of 300 to 400 nm, and the water pressure resistance and moisture permeability were almost the same as in Example 1.

EXAMPLE 3

A polyurethane emulsion obtained by stirring a dry moisture-permeable polyurethane resin (X-3038 supplied by Dainichi Seika) with 40 parts of methylethylketone, 20 parts of toluene, 50 parts of water, and 15 parts of melamine resin particles having an average particle size of 0.3 μm (EPS-S supplied by Nippon Shokubai) was coated in a thickness of 0.15 mm on a nylon/cotton mix-spun twilled fabric and dried to obtain a white sheet having a foamed cell structure. The ultraviolet ray reflectance of the sheet was 93% at a wavelength of 330 to 400 nm.

EXAMPLE 4

A sheet was prepared in the same manner as described in Example 3 except that 10 parts of silica particles having an average particle size of 2.5 μm (Syloid 72 supplied by Fuji-Davison) was used instead of the 15 parts of melamine resin particles used in Example 3. The ultraviolet ray reflectance of the sheet was 85% at a wavelength of 300 to 400 nm.

COMPARATIVE EXAMPLE 1

A sheet was prepared in the same manner as described in Example 1 except that the 15 parts of the melamine resin particles used in Example 1 was not added. The ultraviolet ray reflectance of the sheet was 75% at a wavelength of 300 to 400.

COMPARATIVE EXAMPLE 2

A coating liquid formed by mixing and stirring 100 parts of an unfoamable dry urethane resin of the non-yellowing type (NY-319 supplied by Dai-Nippon Ink) with 15 parts of melamine resin particles having an average particle size of 0.3 μm (EPS-S supplied by Nippon Shokubai) and 30 parts of methylethylketone was coated in a thickness of 0.3 mm and dried on a nylon/cotton mix-spun twilled fabric to obtain an unfoamed sheet. The ultraviolet ray reflectance of the sheet was 60% at a wavelength of 340 to 400 nm.

When the results of Example 1 are compared with the results obtained in Comparative Examples 1 and 2, it becomes obvious that, in the fabric of the present invention, a very high ultraviolet ray reflectance is obtained by the combination of two elements, i.e., the foamed cell structure and the fine particles, and that satisfactory results cannot be obtained if either of these two elements is omitted.

We claim:

1. An ultraviolet ray-reflecting fabric comprising a fibrous fabric substrate and a polymer film formed thereon having a foamed cell structure and containing fine particles comprising melamine resin, wherein the polymer film having a foam cell structure is obtained by coagulating a solution of a urethane resin in a polar solvent with an aqueous coagulant or a film obtained by drying a water-in-oil emulsion of a polyurethane, wherein the fine particles have an average particle size of 0.1-10 microns and show no light absorption in the desired ultraviolet ray wavelength region, and further wherein the fabric has an ultraviolet ray-reflecting efficiency of at least 65% at a wavelength of 350 nm.

2. A fabric as set forth in claim 1, wherein the fabric has a moisture permeability of at least 2000 $g/m^2$.24 hours and a water proofing of at least 500 mm when expressed as water pressure resistance.

* * * * *

UNITED STATES PATENT AND TRADEMARK OFFICE

CERTIFICATE OF CORRECTION

PATENT NO. : 5,134,025

DATED : July 28, 1992

INVENTOR(S) : Zenda et al

It is certified that error appears in the above-identified patent and that said Letters Patent is hereby corrected as shown below:

Column 4, line 13, delete "Fai-Nippon Ink" and replace it with --Dai-Nippon Ink--.

Signed and Sealed this

Second Day of November, 1993

*Attest:*

*Attesting Officer*

BRUCE LEHMAN

*Commissioner of Patents and Trademarks*